US006734403B2

(12) United States Patent
Baker et al.

(10) Patent No.: US 6,734,403 B2
(45) Date of Patent: May 11, 2004

(54) COOKING OVEN INCORPORATING ACCURATE TEMPERATURE CONTROL AND METHOD FOR DOING THE SAME

(75) Inventors: Richard L. Baker, Lewisburg, OH (US); James A. Pyles, Enon, OH (US); John W. Lockwood, Troy, OH (US); Daniel E. Thompson, Troy, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 321 days.

(21) Appl. No.: 09/838,447

(22) Filed: Apr. 19, 2001

(65) Prior Publication Data

US 2003/0015518 A1 Jan. 23, 2003

(51) Int. Cl.[7] ..... H05B 3/02
(52) U.S. Cl. ..... 219/486; 219/490; 219/391
(58) Field of Search ..... 219/483, 486, 219/490, 492, 497, 506, 508, 391, 395, 398; 126/39 R, 41 R, 39 BA, 19 R; 392/307, 310

(56) References Cited

U.S. PATENT DOCUMENTS

| | | | | | |
|---|---|---|---|---|---|
| 2,463,712 | A | * | 3/1949 | Newell | 200/61.86 |
| 4,345,145 | A | * | 8/1982 | Norwood | 219/492 |
| 4,471,193 | A | | 9/1984 | Walter | 219/10.55 B |
| 4,629,865 | A | * | 12/1986 | Freedman et al. | 219/405 |
| 4,692,598 | A | | 9/1987 | Yoshida et al. | 219/497 |
| 4,852,544 | A | | 8/1989 | Williams et al. | 126/39 |
| 5,275,147 | A | * | 1/1994 | Aktinson, III | 126/39 BA |
| 5,302,793 | A | | 4/1994 | Elke | 219/710 |
| 5,332,886 | A | | 7/1994 | Schilling et al. | 219/506 |
| 5,723,846 | A | | 3/1998 | Koether et al. | 219/497 |
| 5,791,890 | A | | 8/1998 | Maughan | 431/6 |
| 6,030,205 | A | * | 2/2000 | Maughan | 431/29 |
| 6,381,518 | B1 | * | 4/2002 | Huffington et al. | 700/299 |

* cited by examiner

*Primary Examiner*—Sang Paik
(74) *Attorney, Agent, or Firm*—John F. Colligan; Robert O. Rice; Stephen Krefman

(57) ABSTRACT

An oven and a method for controlling the ambient temperature in an oven comprising a baking cavity that is preheated with respect to a user-selected temperature set point. The baking cavity can include a rack for supporting a pan that conceptually divides the cavity into an upper heating region and a lower heating region. A broil heating element and corresponding broil temperature sensor are disposed in the upper heating region of the baking cavity. A bake heating element and corresponding bake heating sensor are disposed in the lower heating region of the baking cavity. A controlled is provided to control the activation of the broil and bake heating elements in response to the sensed temperature of the upper and lower heating regions to maintain the entire oven at a temperature substantially equal to a target temperature set point, which is determined based on the user-selected temperature set point.

44 Claims, 11 Drawing Sheets

COOKING OVEN INCORPORATING ACCURATE TEMPERATURE CONTROL AND METHOD FOR DOING THE SAME

BACKGROUND OF THE INVENTION

1. Field of the Invention

In one aspect, the invention relates to an oven having accurate temperature control including a baking cavity with independently-controlled bake and broil heating elements via separate temperature sensors located adjacent each of the corresponding heating elements. In another aspect, the invention relates to a method for independently controlling the bake and broil heating elements in the baking cavity of the oven during a bake cycle of the oven.

2. Description of the Related Art

Electric- and gas-based cooking ovens are old and well-known in the prior art. With reference to FIG. 1, these types of ovens 10 typically comprise an open-face housing defining a baking cavity 12, with the open face enclosed by a hinged door 14. The open face housing is formed by opposing top and bottom walls, opposing end walls, and a rear wall. A broil heating element 16 is mounted adjacent the upper wall of the baking cavity 12 and a bake heating element 18 mounted adjacent the lower wall of the baking cavity. The side walls 20, 22 are provided with rack supports 24 extending generally in horizontal fashion depth-wise into the baking cavity 12 along the side walls 20, 22 for supporting a baking rack 26 thereon.

In control methods for prior art ovens 10, a single temperature sensor 28 is typically located a predetermined distance from each of the broil and bake heating elements 16, 18, respectively, such as along a medial horizontal plane of the baking cavity 12 as shown in FIG. 1. This single temperature sensor 28 was typically used in bake and broil modes of prior art ovens 10 to control the activation and deactivation of the broil and bake heating elements 16, 18.

The use of a single temperature sensor 28 in prior art ovens 10, especially such a sensor 28 spaced a great distance from the associated broil and bake heating elements 16, 18, has not shown to be an effective method by which to produce a constant and effective heating gradient across the vertical height of the baking cavity 12 since heat rises and because the heat differential across the vertical height of the baking cavity can be substantially affected by various types of food products placed on the cooking rack 28 (e.g., a frozen poultry product versus a room temperature mixture) and the shape and size of the pan holding the food product.

For example, the pan interferes with the vertical flow path of the heat air rising from the bake element. Typically, the larger the pan, the greater the interference. The interference results in the heated air building up along the bottom of the pan and flowing around the sides of the pan, which prevents an even distribution across the top of the pan, resulting in a region of lower temperature air above the pan and very heated air below the pan. The food product can exacerbate the low temperature region if the food product is at substantially lower temperature than the surrounding air, effectively functioning as a cooling point source. The end result is an undesirable temperature gradient on opposite sides of the pan.

It has been found that the location of a single temperature sensor 28 located at upper end of the baking cavity 12 is ineffective in providing input to a controller for activating and deactivating the broil and bake heating elements 16 and 18 in a manner capable of reducing or eliminating the temperature gradient across the pan.

There have been prior art attempts to install multiple temperature sensors 28 in the baking cavity 12 of an oven 10, however, these prior art attempts have been to solve problems unrelated to the even heating along the height of the oven cavity.

For example, U.S. Pat. No. 5,723,846 to Koether, et al., issued Mar. 3, 1998, discloses the use of a pair of temperature sensors located adjacent heating elements both located on an upper wall of a baking cavity in a convection oven used for error detection purposes in sensing error conditions in the convection oven.

U.S. Pat. No. 5,791,890 to Maughan, issued Aug. 11, 1998, discloses a temperature sensor located adjacent each bake and broil heating element in a gas oven used for the purpose of detecting a positive proof of ignition in each of the gas-based heating elements.

U.S. Pat. No. 5,332,886 to Schilling et al., issued Jul. 26, 1994, discloses an electronic regulator for an electric oven having a controller provided with a fixed program to process data from a real temperature sensor and separate temperature sensors for producing error correction values on the ambient temperature in the baking cavity for converting the dependence between the temperature values of the real temperature sensor and the measuring temperature device into additional process data.

None of the dual sensor applications address the problem of accurately controlling the temperature of the oven baking cavity during a bake cycle of the oven to obtain an even heat distribution along the height of the oven.

SUMMARY OF THE INVENTION

The invention relates to a method for accurately controlling the ambient temperature in an enclosed baking cavity of an oven that is preheated with respect to a user-set temperature set point. The baking cavity of the oven comprises a broil heating element mounted to an upper portion of the baking cavity and a bake heating element mounted to a lower portion of the baking cavity, thereby defining a baking region therebetween. A broil temperature sensor is mounted within the baking cavity adjacent to the broil heating element. Similarly, a bake temperature sensor is mounted within the baking cavity adjacent to the bake heating element.

One method of controlling the oven comprises the following steps: providing a controller capable of actuating the broil and bake heating element in response to broil and bake temperature sensors; determining a target temperature set point for the oven cavity based on the user-set temperature set point; sensing the temperature of the baking region adjacent at least one of the bake and broil heat elements; comparing the sensed temperature with the target temperature set point; and, selectively actuating the broil and bake heating elements in response to the sensed temperature to maintain a vertical temperature distribution in the oven cavity that is substantially equal to the target temperature set point.

The steps in determining a target temperature set point can comprise calculating the heating element set point comprising one of a broil set point and a bake set point derived from the target temperature set point. The calculation of the bake and broil element set points preferably comprises selecting the one of the bake and broil set points from a data table containing a list of target temperature set points and a corresponding list of at least one of the bake and broil set points. The bake and broil set points preferably comprise a range of temperature values delimited by a low temperature limit and a high temperature limit.

Alternatively, the calculation of the broil and bake set points can comprise selecting a temperature differential value corresponding to the target temperature set point and summing the temperature differential value with the selected at least one of the bake and broil set points to calculate the other of the at least one of the bake and broil set points. The temperature differential value can be either negative or positive.

The step of sensing the temperature preferably comprises reading a sensor temperature signal comprising one of a bake temperature signal and a broil temperature signal read from the corresponding bake temperature sensor and broil temperature sensor.

The selective actuation of the broil and bake heating elements preferably comprises alternately activating the bake and broil heating elements. The alternate activation typically includes deactivating the heating element corresponding to the sensed temperature if the sensed temperature exceeds the corresponding heating element set point, activating the heating element corresponding to the sensed temperature if the sensed temperature is less than the corresponding heating element set point, and deactivating the heating element other than the heating element corresponding to the sensed temperature if the sensed temperature is less than the heating element set point. Preferably, only one heating element is activated at a time. Also, the activation of the bake and broil heating elements is preferably continued for a predetermined duty cycle as long as the other bake and broil element is deactivated.

The method can further comprise the step of detecting whether the oven is gas-based or electric based. If the oven is gas based, the method can include determining whether a purge time limit for the broil heating element has been satisfied.

The method can also comprise compensating the heating element set point based upon an initial heating condition of the baking cavity. The heating element set point is preferably increased in the compensation step. The compensation step can further comprise adjusting the heating element set point according to a predefined function, which is preferably a decreasing linear function.

In another aspect, the invention relates to an oven incorporating accurate ambient temperature control. The oven comprises a housing defining an enclosed baking cavity. At least one oven rack for supporting a pan is disposed within the cavity and conceptually divides the cavity into an upper heating region above the rack and a lower heating region below the rack. A broil heating element is mounted in the upper heating region of the baking cavity. Similarly, a bake heating element is mounted in the lower heating region of the baking cavity. A broil temperature sensor is mounted within the upper heating region adjacent to the broil heating element. Similarly, a bake temperature sensor is mounted within the upper heating region adjacent to the bake heating element. A controller is operably interconnected to a power source and to the broil heating element, bake heating element, the broil temperature sensor and the bake temperature sensor for selectively actuating the broil heating element and the bake heating element in response to the sensed temperatures of the upper and lower heating regions to maintain the temperature of the upper and lower heating regions substantially equal to a target temperature set point.

The controller preferably calculates the heating element set point comprising one of the broil set point and a bake set point derived from the target temperature set point. A sensor temperature signal comprising one of a bake temperature signal and a broil temperature signal is read from the corresponding heating element sensor comprising one of the bake temperature sensor and broil temperature sensor. The controller preferably compares the sensor temperature signal to the heating element set point. The controller deactivates the corresponding heating element if the sensor temperature signal exceeds the heating element set point. The controller also activates the corresponding heating element if the sensor temperature signal is less than the heating element set point. The controller can deactivate the heating element other than the corresponding heating element if the sensor temperature signal is less than the heating element set point.

Preferably, the controller includes a database comprising multiple target temperature set points and corresponding broil set points and bake set points, whereby the bake and broil set points can be selected from the table according to the target temperature set point. Preferably, the broil set point and the bake set point each comprise a range of temperature values delimited by a low temperature limit and a high temperature limit.

The controller deactivates one of the bake and broil heating elements if one of the bake and broil elements is activated and if the corresponding bake or broil temperature signal exceeds the corresponding bake or broil set point by a predetermined amount. The controller activates one of the bake and broil heating elements for a predetermined duty cycle as long as the other of the bake and broil heating elements is deactivated.

The controller can compensate the heating element set point based upon an initial heating condition of the baking cavity. The compensation increases the heating element set point. Preferably, the compensation adjusts the heating element set point according to a predefined function, which is preferably a decreasing linear function.

In yet another aspect, the invention relates to a method for maintaining an even temperature distribution in a baking cavity of an oven relative to a user-defined temperature set point. The baking cavity of the oven comprises a rack for supporting a pan, with the rack functionally dividing the cavity into an upper heating region above the rack and a lower heating region below the rack. A broil heating element is provided in the upper heating region along with a corresponding broil temperature sensor. A bake heating element is provided in the lower heating region along with a corresponding bake temperature sensor. The method comprises the steps of: providing a controller capable of actuating the broil and bake heating elements in response to the broil and bake temperature sensors; determining a target temperature set point for the oven cavity based on the user-selected temperature set point; sensing the temperature of the upper and lower heating region; comparing the sensed temperatures with the target temperature set point; and selectively actuating the broil and bake heating elements in response to the sensed temperatures to maintain the temperature of the upper and lower heating regions substantially equal to the target temperature set point.

DESCRIPTION OF THE PREFERRED EMBODIMENT

Figure 2:
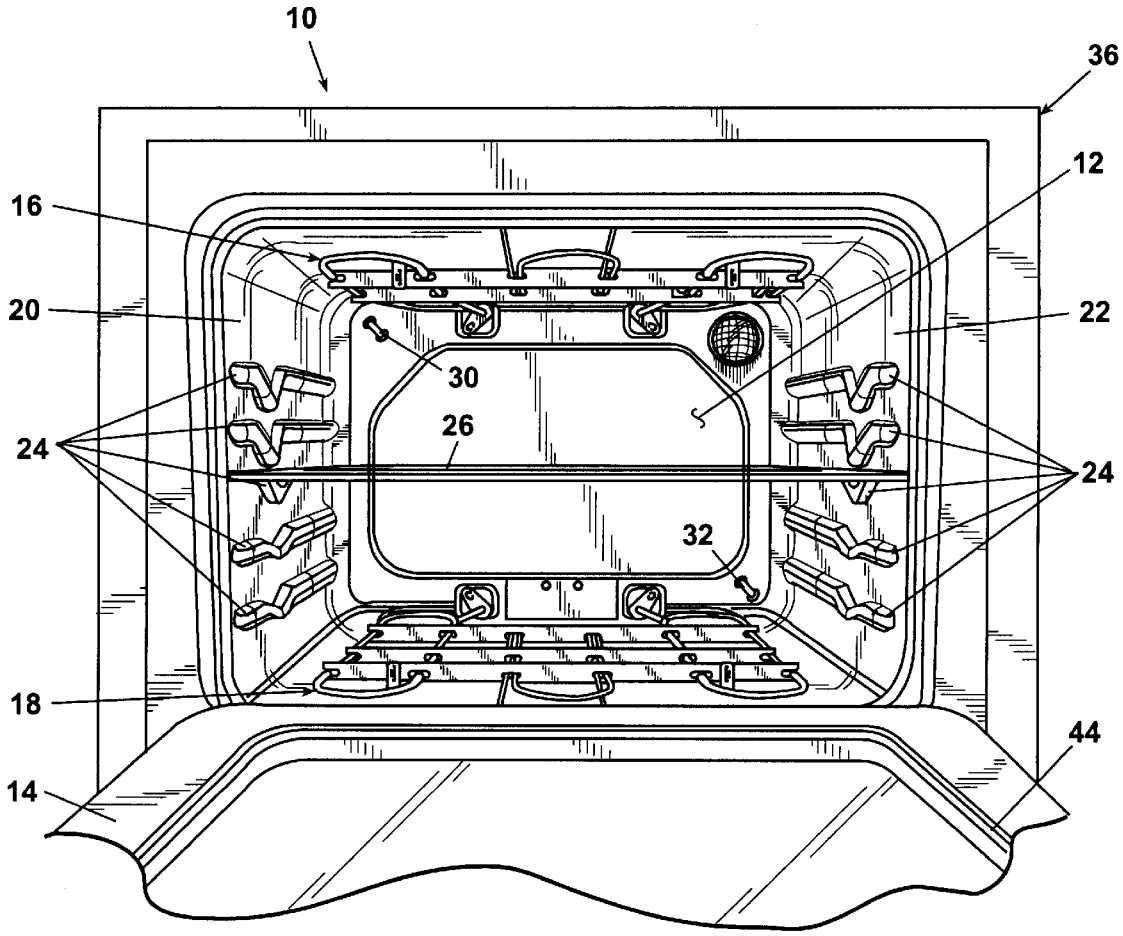
FIG. 2 is a perspective view in the same orientation as FIG. 1 but showing a baking cavity for an oven according to the invention having separate temperature sensors, one located adjacent a broil heating element at the top of the baking cavity and one located adjacent a bake heating element located at the bottom portion of the baking cavity.
Figure 3:
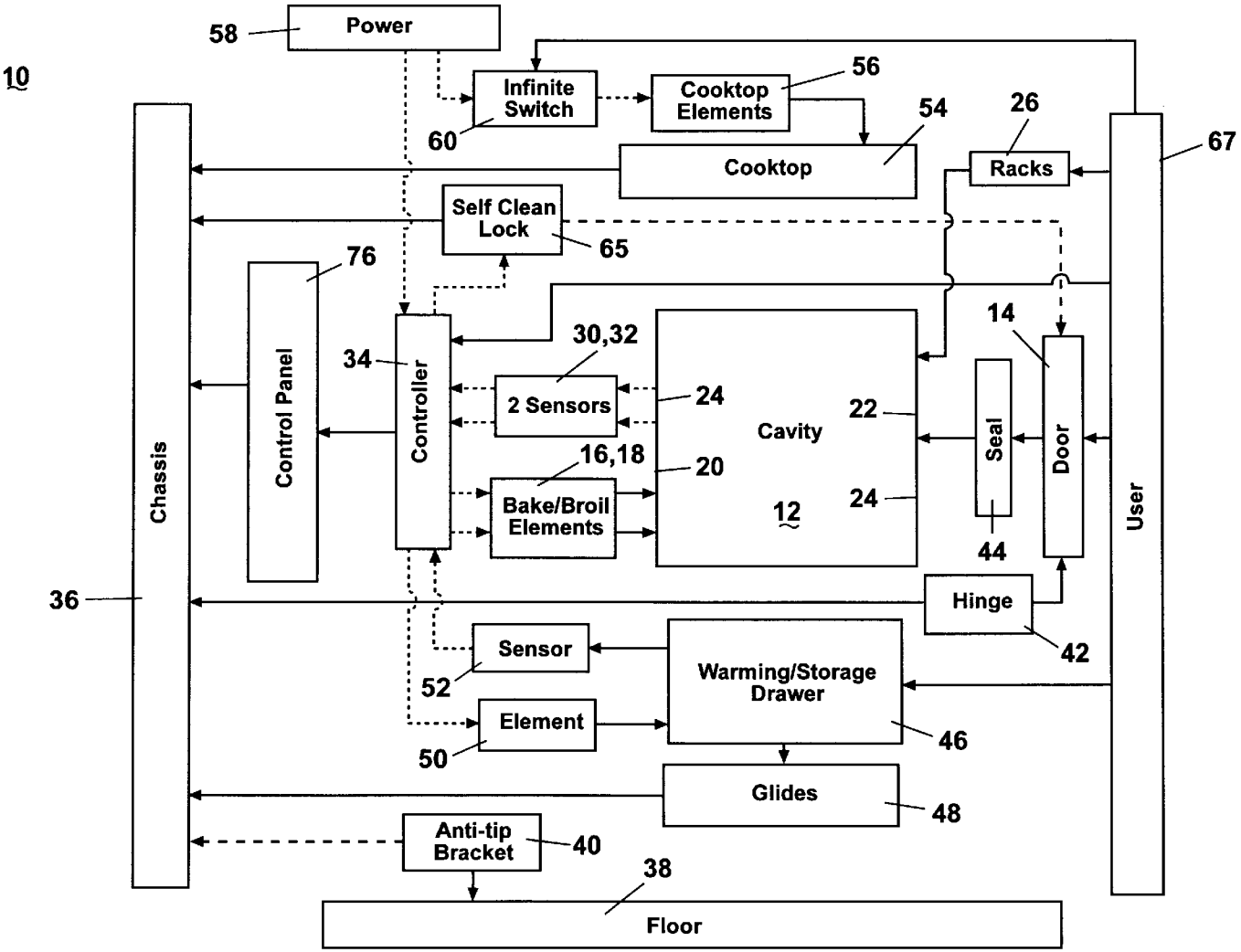
FIG. 3 is a block diagram showing the general components of the oven of FIG. 2 configured for electric-based heating elements.
Figure 4:
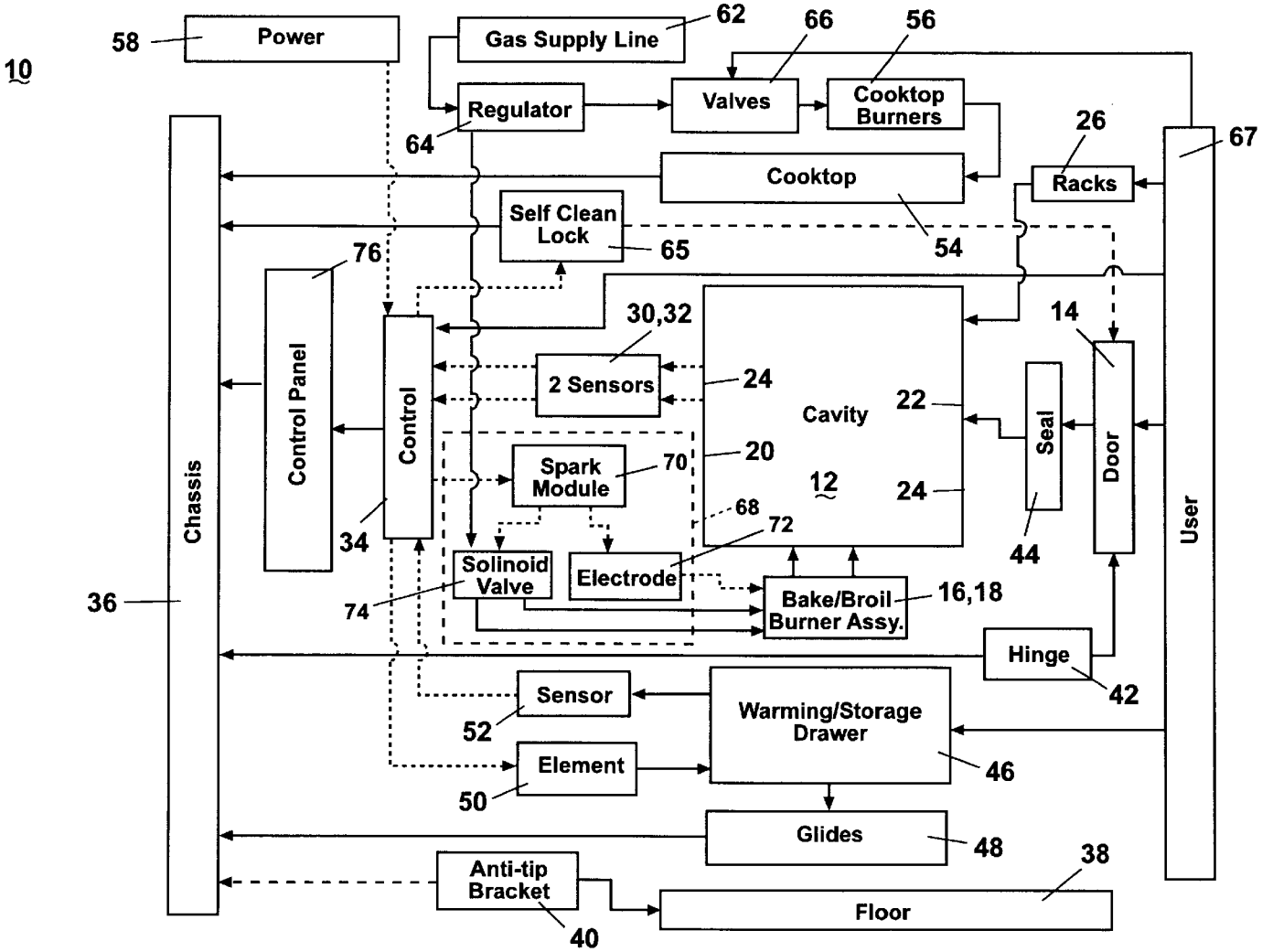
FIG. 4 is a block diagram showing the general components of the oven of FIG. 2 configured for gas-based heating elements.
Figure 5:
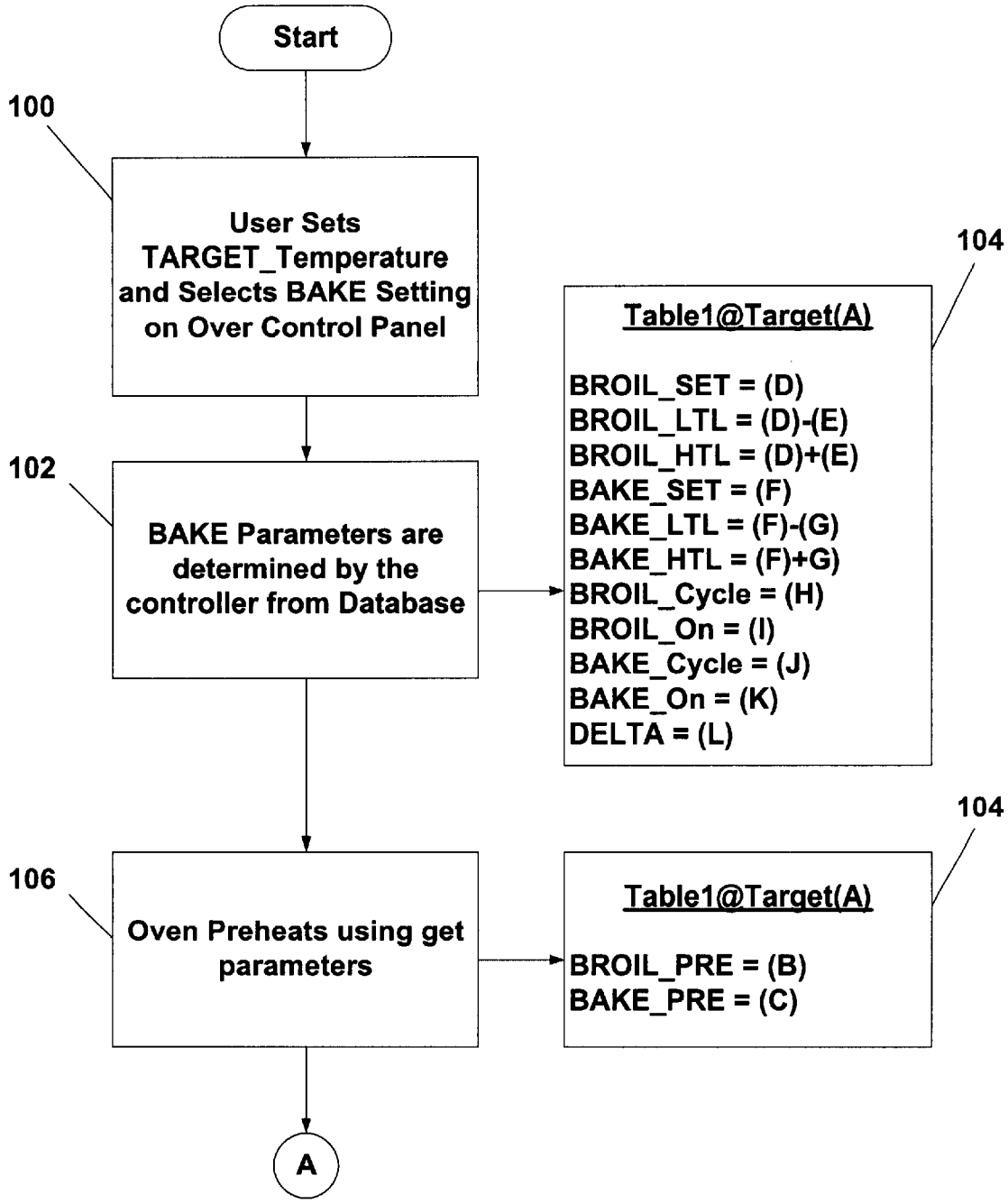
FIG. 5 is a flowchart for controlling the temperature of the baking cavity of the ovens shown in FIGS. 2–4, specifically showing the steps of gathering information from a user, determining specific parameters for the bake mode and preheating the baking cavity of the oven using those set parameters in proceeding to the flowchart shown in FIG. 6.

Referring now to the drawings and to FIGS. 2–4 in particular, the oven 10 is shown in FIGS. 2–3 configured for electric-based heating elements and in FIG. 4 for gas-based heating elements in which a broil temperature sensor 30 is located adjacent to a broil heating element 16 and a bake temperature sensor 32 is located adjacent a bake heating element 18. The broil temperature sensor 30 and the bake temperature sensor 32 are interconnected to a controller 34.

Figure 1:
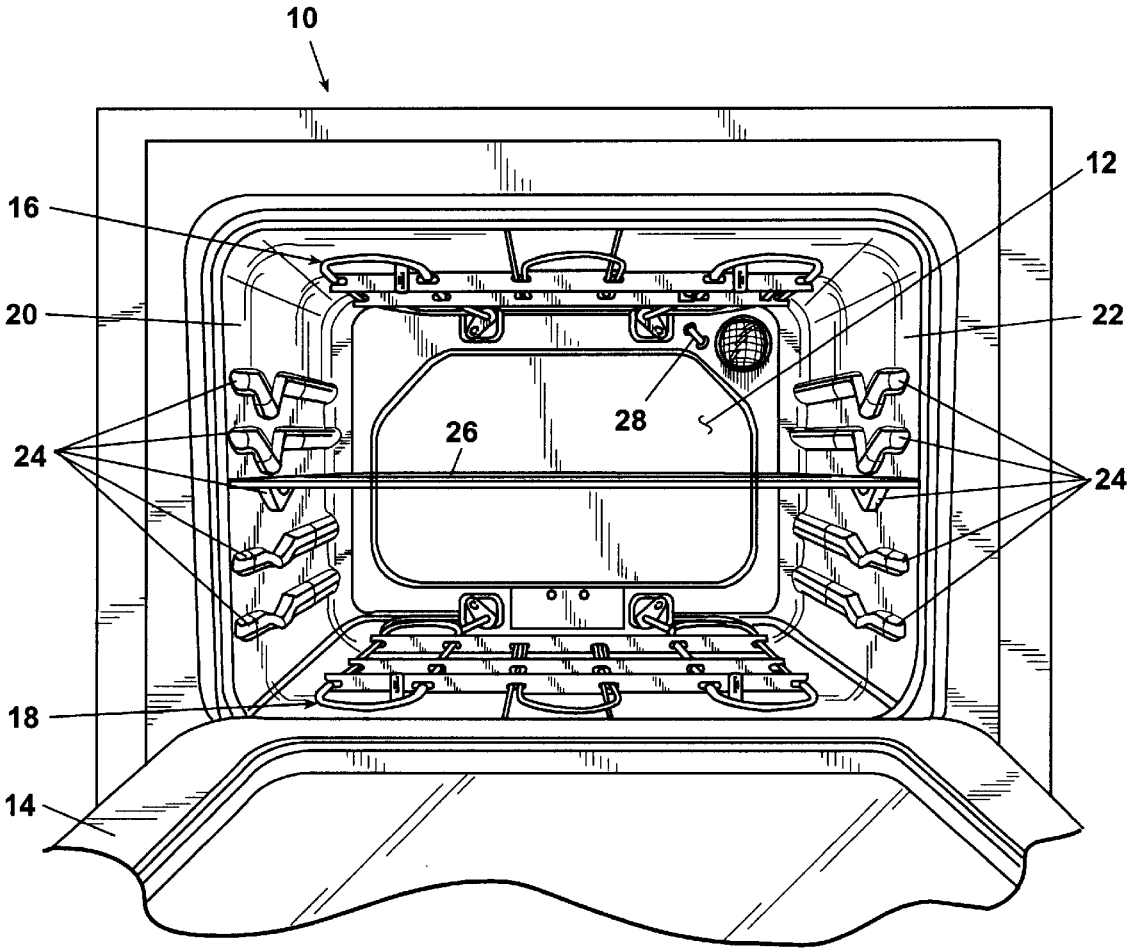
Fig. 1 (PRIOR ART)
FIG. 1 is a perspective view looking into a prior art baking cavity of an oven with a door therefor shown in fragmentary perspective view, wherein the baking cavity has a single temperature sensor located near the upper end of the baking cavity.

It will be understood that the oven 10 shown in FIGS. 2–4 having common elements with the prior art oven in FIG. 1 are referred to with common reference numerals, i.e., the baking cavity 12, door 14, heating elements 16, 18, side walls 20, 22, rack supports 24, and baking rack 26 are all referred to with the same reference numerals in FIGS. 2–4 as they were in FIG. 1.

FIGS. 3–4 show block diagrams of electric-and gas-based ovens, 10, respectively, since the particular mechanical interconnection and assembly of the elements of the block diagrams shown in FIGS. 3–4 are not critical to the invention and any of the well known components making up prior art ovens will suffice as this invention relates to the method of controlling the broil temperature sensor 30 and the bake temperature sensor 32.

With reference to FIGS. 3–4, the general components making up the oven 10 according to the invention include an oven chassis 36 that supports the components making up the oven 10 on a floor 38. An anti-tip bracket 40, mechanically couples the chassis 36 to either the floor or the wall to prevent the oven from tipping when a large weight is placed on the door 14. The door 14 is typically mounted to the chassis 36 by a hinge 42 and maintains the integrity of the baking cavity 12 by a seal 44 that is preferably effective in preventing heat from escaping the cavity 12.

A warming/storage drawer 46 is typically provided at a lower portion of the chassis 36 and mounted thereto by conventional glides 48 permitting slidable movement of the warming/storage drawer 46 relative to the chassis 36. The warming/storage drawer 46 is typically provided with its own heating element 50 interconnected to the controller 34 and actuated by the controller 34 via a signal from a temperature sensor 52 located within the warming/storage drawer 46.

The oven 10 can also include a conventional cooktop 54 typically comprising several cooktop burners or elements 56. In the electric-based oven 10 shown in FIG. 3, the cooktop burners/elements 56 are interconnected to an electric power supply 58 via a switch 60 as is conventionally known. In the gas-based oven 10 shown in FIG. 4, the cooktop burners/elements 56 are interconnected to a gas supply line 62 via a regulator 64 and several valves 66 also as is conventionally known. In both the embodiments of FIGS. 3–4, the power supply 58 is also interconnected to the controller 34 to supply power thereto.

A latch 65 is also mounted on the chassis 36 and preferably interconnected to the controller 34 and the door 14. A user 67 manually actuates the latch 65 to latch the door to the chassis 36 to lockably enclose the cavity 12. Further, the controller 34 can send a signal to the latch 65 to automatically lock the door 14 to the chassis 36 enclosing the cavity during oven cleaning operations thus preventing the user 67 from opening the door 14.

In the electric-based oven 10 shown in FIG. 3, the broil heating element 16 and the bake heating element 18 are directly interconnected to the controller 34, which controllably supplies power from the power supply 58 to selectively heat the cavity 12 in a controlled fashion. In the gas-based version shown in FIG. 4, the broil heating element 16 and the bake heating element 18 are interconnected to the controller 34 via a gas control assembly 68 that comprises a spark module 70 (i.e., an igniter) for passing a spark to an electrode 72 which, in turn, interacts with a volume of gas released by a solenoid valve 74 that is interconnected to the gas supply line 62 via the regulator 64.

The controller 34 is interconnected to a control panel 76 mounted to the chassis 36 that contains among other things, actuator devices such as control knobs that allow the user 67 to set, among other things, the particular heating mode of the oven 10 (e.g., BAKE, BROIL, CLEAN, etc.) and, to the extent the user has selected either the bake or broil heating modes, a target temperature set point at which the user desires to cook food products in the baking cavity 12.

For the purposes of the flowcharts describing the inventive method herein of FIGS. 5–11, it is assumed that the user 67 has accessed the control panel 76 and set the heating mode of the oven to BAKE and actuated another of the control knobs thereon to set a target temperature set point (i.e., the desired temperature to which the baking cavity 12 is to be heated and closely controlled and maintained at that temperature during the BAKE cycle).

On a typical control knob for setting the target temperature set point TARGET_TEMP, the user 67 is typically allowed to select from various temperatures in 25–50 degree increments in degrees F. such as 200, 250, 300, 325, 350, 400, 450, 475, etc. The method of controlling the temperature of the baking cavity 12 at the user selected target temperature set point TARGET_TEMP in the BAKE mode is shown at 100 in FIG. 5. Once these parameters are set by user at step 100 processing moves to step 102 wherein further bake mode parameters are determined by the controller 34 from a database 104. The database 104 can be any simple look-up table or a relational database that supplies data to the controller 34 based upon the make and/or model of oven 10 employed. An example of the database 104 appears in the following Table 1.

330–440° F. and the high temperature band ranges from 450° F. and higher. These groupings were made by trial selection. It has been found that particular heating ranges such as the low, mid and high temperature bands shown in Table 1 each exhibit common characteristics which allow certain equations to be attributed individually to the two target temperatures falling within these target temperature bands as will be further described below.

Columns B and C of the database 104 shown by example in Table 1 include target set temperature points for the broil heating element 16 and the bake heating element 18, respectively. These values represent the desired targets to have the broil temperature sensor 30 and the bake temperature sensor 32 read during preheating of the oven 10. It will be noted that the preheat broil target temperature of column B and the preheat bake target temperature of column C exceed the target temperature of column A by 30, 30 and 20 for the low-, mid- and high-temperature bands, respectively.

It should not be limiting to this invention that the preheat, broil, and preheat bake target temperatures are shown as equal values as it is equally contemplated that these values could differ under a different oven preheating cycle. Further, the "overshoot" differences, i.e., the amount the preheat broil and preheat bake target temperatures of columns B and C of the database 104 of Table 1 exceed the target temperature set point of Column A, can also be selected as different values without departing from the scope of this invention as those values shown are by example and not by limitation.

Columns D–E and F–G of the database 104 shown by example in Table 1 contain a target set point and range

TABLE 1

Bake Method Temperature and Time Set Points (all Temperatures in degrees F. and times in seconds)

| | | Preheat | | Broil | | Bake | | Broil | | Bake | | |
|---|---|---|---|---|---|---|---|---|---|---|---|---|
| Temp Band | A Target | B Broil | C Bake | D Set Point | E Amplitude | F Set Point | G Amplitude | H Cycle Time | I On Time | J Cycle Time | K On Time | L Delta |
| LOW | 200 | 230 | 230 | 188 | 1 | 182 | 1 | 60 | 15 | 60 | 60 | 6 |
| | 250 | 280 | 280 | 238 | 1 | 232 | 1 | 60 | 15 | 60 | 60 | 6 |
| | 300 | 330 | 330 | 288 | 1 | 282 | 1 | 60 | 15 | 60 | 60 | 6 |
| | 325 | 355 | 355 | 313 | 1 | 307 | 1 | 60 | 15 | 60 | 60 | 6 |
| MID | 330 | 360 | 360 | 314 | 1 | 302 | 1 | 60 | 35 | 60 | 60 | 12 |
| | 350 | 380 | 380 | 334 | 1 | 322 | 1 | 60 | 35 | 60 | 60 | 12 |
| | 400 | 430 | 430 | 384 | 1 | 372 | 1 | 60 | 35 | 60 | 60 | 12 |
| | 440 | 470 | 470 | 424 | 1 | 412 | 1 | 60 | 35 | 60 | 60 | 12 |
| HIGH | 450 | 470 | 470 | 434 | 1 | 420 | 1 | 60 | 40 | 60 | 60 | 14 |
| | 475 | 495 | 495 | 459 | 1 | 445 | 1 | 60 | 40 | 60 | 60 | 14 |

The example database 104 shown in Table 1 has twelve columns labeled consecutively by letters A–L. Column A in Table 1 corresponds to the target temperature set point TARGET_TEMP set by the user 67 on the control panel 76. Table 1 contains several rows each corresponding to the typical temperature settings on a control knob on the control panel 76 for setting the desired target temperature set point TARGET_TEMP. Table 1 shows several rows corresponding to these typical values in degrees F. including 200, 250, 300, 325, 330, 350, 400, 440, 450 and 475. It should be known that this invention is not limited by the values shown in Table 1 as these should be interpreted as merely an example of the data used by the controller 34 and should not be limiting on the invention.

Table 1 also includes a first column which breaks down the rows of Table 1 into low, mid, and high temperature bands wherein the low temperature band ranges from 200–325° F., the mid temperature band ranges from amplitude for the broil heating element 16 and the bake heating element 18 as to be detected by the broil temperature sensor 30 and the bake temperature sensor 32, respectively, during the BAKE mode as selected by the user 67 for a particular target temperature set point TARGET_TEMP. These values permit the controller 34 to calculate low temperature limit and high temperature limit set points for the broil heating element 16 and the bake heating element 18.

For example, at a particular target temperature set point TARGET_TEMP selected by the user 67, the database 104 looks up a corresponding value in Column A and sets a variable BROIL_SET to the value in Column D (e.g., 334° F. at a desired target temperature TARGET_TEMP of 350° F.). The controller 34 then calculates a broil heating element low temperature limit BROIL_LTL by subtracting the amplitude in Column E from the set point temperature in Column D and calculates a broil heating element high temperature limit BROIL_HTL by adding the amplitude in Column E to the broil set point temperature in Column D.

For example, at a particular target temperature set point TARGET_TEMP selected by the user 67, the database 104 looks up a corresponding value in Column A and sets a variable BAKE_SET to the value in Column F (e.g., 322° F. at a desired target temperature set point TARGET_TEMP of 350° F.). The controller 34 then calculates a bake heating element low temperature limit BAKE_LTL by subtracting the amplitude in Column G from the set point temperature in Column F and calculates a bake heating element high temperature limit BAKE_HTL by adding the amplitude in Column G to the bake set point temperature in Column F.

Columns H and I define the duty cycle for the broil heating element 16, i.e., the length of time comprising the normal heating cycle of the broil heating element 16 and the length of time (in seconds) that the broil heating element 16 is on during that time. Column H represents the length of time BROIL_CYCLE that the broil heating element 16 stays on upon a signal to activate the broil heating element 16 from the controller 34. Column I represents the amount of time in seconds BROIL_ON that the broil heating element is actually emitting heat during the BROIL_CYCLE. For example, at a desired target temperature of 350°, the broil heating element 16 has a total cycle time of 60 seconds (Column H at a target temperature set point of 350° from Column A) and the broil heating element stays on approximately 35 seconds out of that 60-second time (Column I at a desired target temperature set point of 350° in Column A).

Columns J and K define the duty cycle for the bake heating element 18, i.e., the length of time comprising the normal heating cycle of the bake heating element 18 and the length of time (in seconds) that the bake heating element 18 is on during that time. Column J represents the length of time BAKE_CYCLE that the bake heating element 18 stays on upon a signal to activate the bake heating element 18 from the controller 34. Column K represents the amount of time in seconds BAKE_ON that the bake heating element 18 is actually emitting heat during the BAKE_CYCLE. For example, at a desired target temperature of 350° the bake heating element 18 has a total cycle time of 60 seconds (Column J at a target temperature set point of 350° from Column A) and the bake heating element 18 stays on approximately 35 seconds out of that 60-second time (Column K at a desired target temperature set point of 350° in Column A).

Column L is an optional column in the database which is essentially used as a tool to conserve memory in the controller 34 by creating a value DELTA in Column L which defines the relationship between the bake set point in Column F and the broil set point in Column D., i.e., DELTA in Column L represents the number of degrees F. by which the broil set point of Column D exceeds the bake set point in Column F. Thus, if the DELTA value in Column L is employed, one of the broil set points in Column D and the bake set point BAKE_SET in Column F is unnecessary as the other of these two values could be calculated by adding or subtracting the DELTA value in Column L to either Column D or Column F.

Thus, memory can be conserved by employing the fewer bits to represent the DELTA value in Column L rather than the larger number of either Column D or Column F (BROIL_SET or BAKE_SET) which requires more bits to store this value. While this memory saving may not be a concern with controllers 34 with large amounts of RAM or ROM, this memory saving technique can be significant for controllers 34 with smaller amounts of memory.

In summary, when the user sets the desired target temperature set point TARGET_TEMP and selects the bake mode on the control panel 76 at step 100, the processing moves to step 102 where the controller 34 looks up and calculates the following bake parameters from the database 104 shown by example in Table 1. All values in Table 1 are shown in degrees F. and all times are shown in seconds. Also, in the following equations, a capital letter shown in parentheses (e.g., (D)) represents a value from the column identified by the letter in parentheses at the intersection of the row corresponding to the desired target temperature set point TARGET_TEMP set by the user 67 on the control panel 76.

BROIL_SET=(D) (or) (F)+(L);
BROIL_LTL=BROIL_SET−(E);
BROIL_HTL=BROIL_SET+(E);
BAKE_SET=(F) (or) BROIL_SET−(L);
BAKE_LTL=BAKE_SET−(G);
BAKE_HTL=BAKE SET+(G);
BROIL_CYCLE=(H);
BROIL_ON=(I);
BAKE_CYCLE=(J);
BAKE_ON=(K); and
DELTA (if used)=(L).

The database 104 can also be used to look up the preheating target set point temperatures BROIL_PRE=(B) and BAKE_PRE=(C).

It is important to note that the parameters and the corresponding values shown in Table 1 are illustrative and not limiting to the invention. The particular values for each of the parameters can vary depending on the particular oven characteristics, such as, for example: baking cavity volume, broiler heating output, oven heating output, and desired response time in the case of the initial temperature overshoot. The particular values for a given oven can be determined by standard testing procedures.

Once these values are established, processing moves to step 106 in which the oven is preheated using the parameters looked up in the database 104 in step 102. The preheat routine is relatively simple and relates to selectively actuating the broil heat element 16 until the broil temperature sensor 30 reads an excess of BROIL_PRE and selectively actuating the bake heating element 18 until the bake temperature sensor 32 reads an excess of BAKE_PRE. It is preferred that the broil heating element 16 and the bake heating element 18 be actuated independently of each other so that at no time the broil heating element 16 is on the same time as the bake heating element 18 since the actuation of both heating elements 16 and 18 at once can cause the rate of ambient temperature rise in the baking cavity 12 to increase dramatically, often beyond the ability of the controller 34 to compensate for this increase. It will also be understood that the broil heating element 16 and the bake heating element 18 are preferably actuated according to their duty cycles defined in columns H–I and J–K by the BROIL_CYCLE, BROIL_ON, BAKE_CYCLE and BAKE_ON parameters determined in step 102 by a look up to the database 104.

Figure 6:
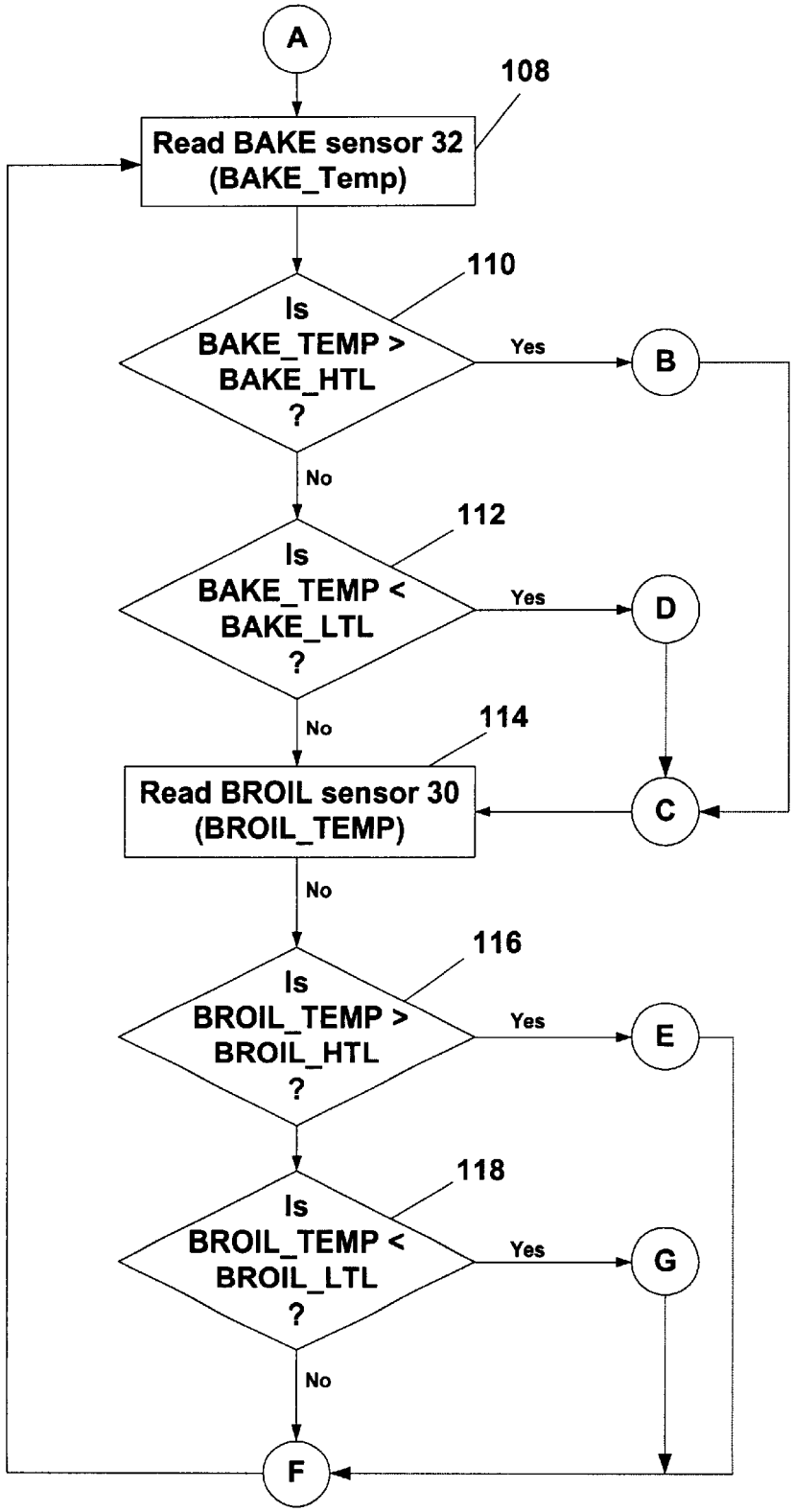
FIG. 6 is a flowchart continuing from point "A" of FIG. 5 and shows a main set of steps for checking the temperature sensors shown in FIG. 2 adjacent each of the bake and broil heating elements and calling subprocesss in FIGS. 7, 8, 9 and 10 as indicated by subprocess calls "B", "D", "E", and "G", respectively.

Once the oven has preheated, typically by overshooting the desired target temperature TARGET_TEMP, processing moves to a connecting flowchart in FIG. 6 via connector "A".

An overview of the control process will be useful in understanding the detailed operation. After the setting of the control parameters (FIG. 5), the broil and bake heating elements 16 and 18 are activated to maintain the temperature of the cavity adjacent the corresponding broil and bake temperature sensors 30 and 32 between the high and low temperature limit set points, respectively (FIG. 6).

Figure 7:
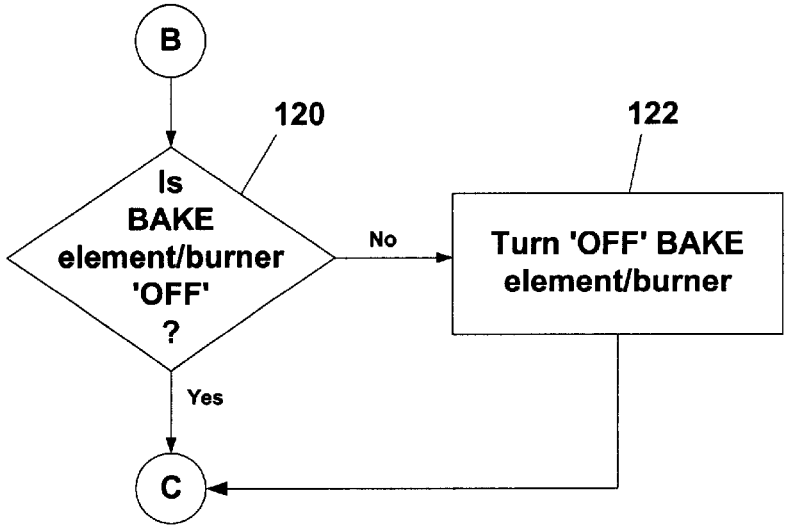
FIG. 7 is a flowchart showing the method steps performed if subprocess "B" is called from FIG. 6.

It is preferred that neither the bake or the broil element are simultaneously activated (FIGS. 7–10) and priority is given to the bake element (FIG. 7). In other words, if both the bake and broil heating elements require activation, the bake element is activated even if the broil element must be turned off.

Figure 2A:
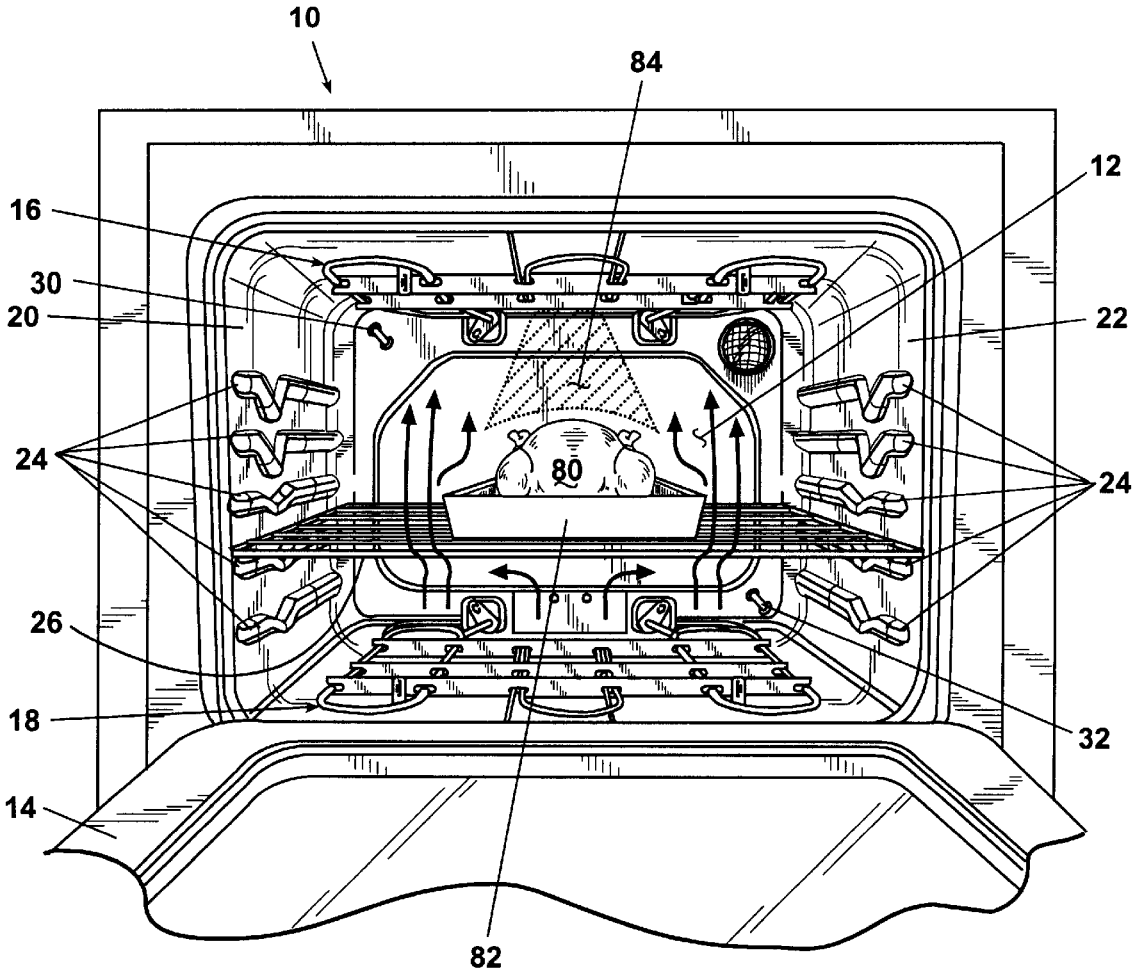
FIG. 2A is a perspective view of the baking cavity of FIG. 2 wherein a food product in a baking pan is placed on the rack in the baking cavity and arrows show the general heat track around the baking pan and food product when the bake heating element is activated whereby a dead heating zone is defined above the food product.
Figure 2B:
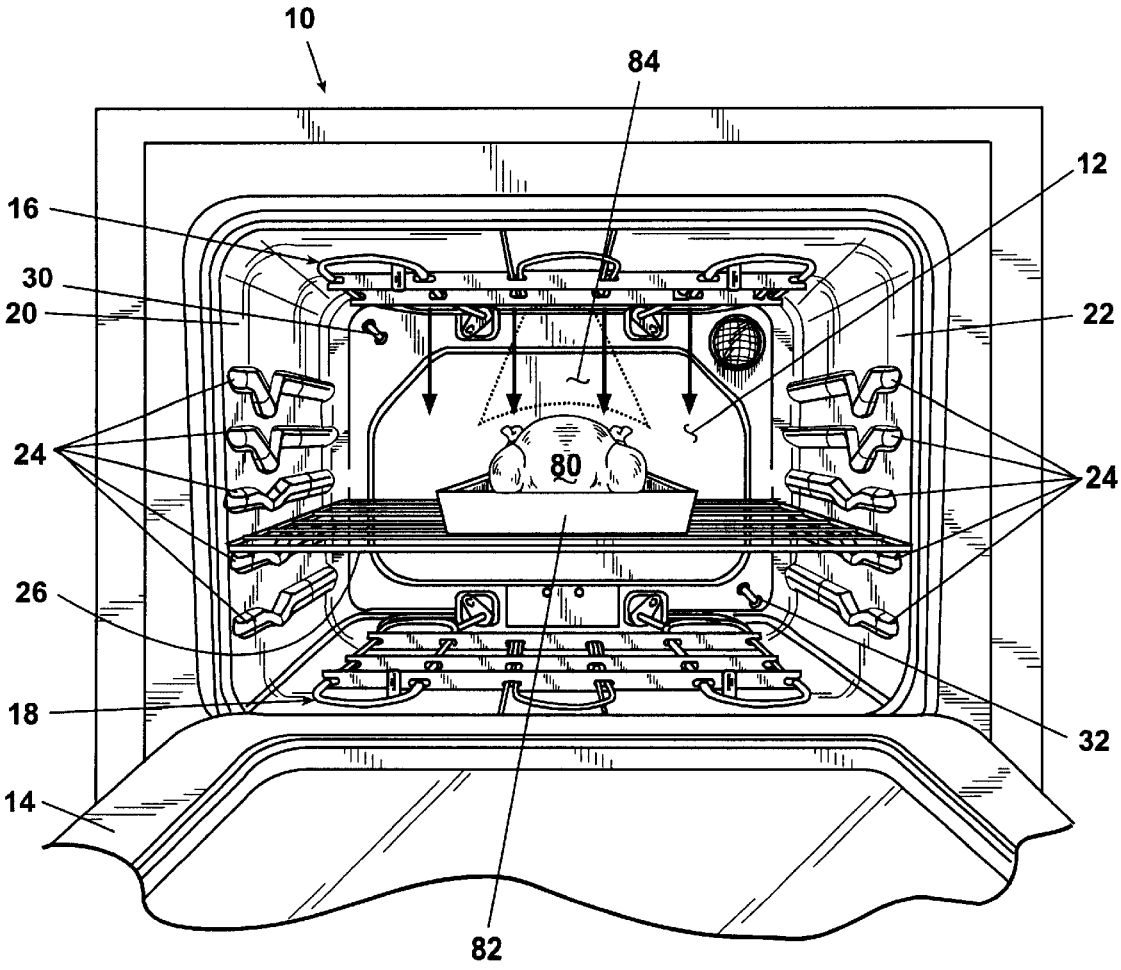
FIG. 2B is a perspective view of the baking cavity of FIG. 2 wherein a food product in a baking pan is placed on the rack in the baking cavity and arrows show the general heat track around the baking pan and food product when the broil heating element is activated thus reducing the negative baking effects of the dead heating zone above the food product shown in FIG. 2A.

The benefits of alternate actuation of the bake and broil heating elements (18 and 16) can be seen from an examination of FIGS. 2A and 2B. FIG. 2A is a perspective view of the baking cavity 12 of FIG. 2 wherein a food product 80 in a baking pan 82 is placed on the rack 26 in the baking cavity 12. As can be seen from FIG. 2A, arrows show the general heat track around the baking pan 82 and food product 80 when the bake heating element 18 is activated. Since the heat from the bake heating element 18 generally tracks around the baking pan 82 and food product 80 and then generally rises vertically, a dead heating zone 84 is defined above the food product 80 where the heat from the bake heating element 18 does not effectively cook the food product 80. In the case of a low temperature item such as frozen poultry, this dead heating zone 84 can cause significant detriment to the cooking of the food product 82.

This invention addresses this problem by periodically activating the broil heating element 16 based upon signals from the broil temperature sensor 30 in addition to the periodic activation of the bake heating element 18 based upon signals from the bake temperature sensor 32. This causes heat to be applied to the food product 80 from above as well as shown in FIG. 2B. The arrows in FIG. 2B show the general heat toward the food product 80 from the broil heating element 16 directly through the dead heating zone 84 thus reducing the negative baking effects of the dead heating zone 84 above the food product 80.

FIG. 6 represents the main control routine for controlling the temperature in the baking cavity 12 of the oven 10. Processing then moves to step 108 in which the controller accepts a signal BAKE_TEMP from the bake temperature sensor 32, which is indicative of the temperature in the cavity 12 at the sensor 32 location. Processing moves to decision point 110 where it is determined whether BAKE_TEMP exceeds the desired high temperature limit for the bake heating element BAKE_HTL. If so, processing passes to the subprocess shown in FIG. 7 via connector "B" in FIG. 6. If not, processing moves to decision point 112.

Figure 8:
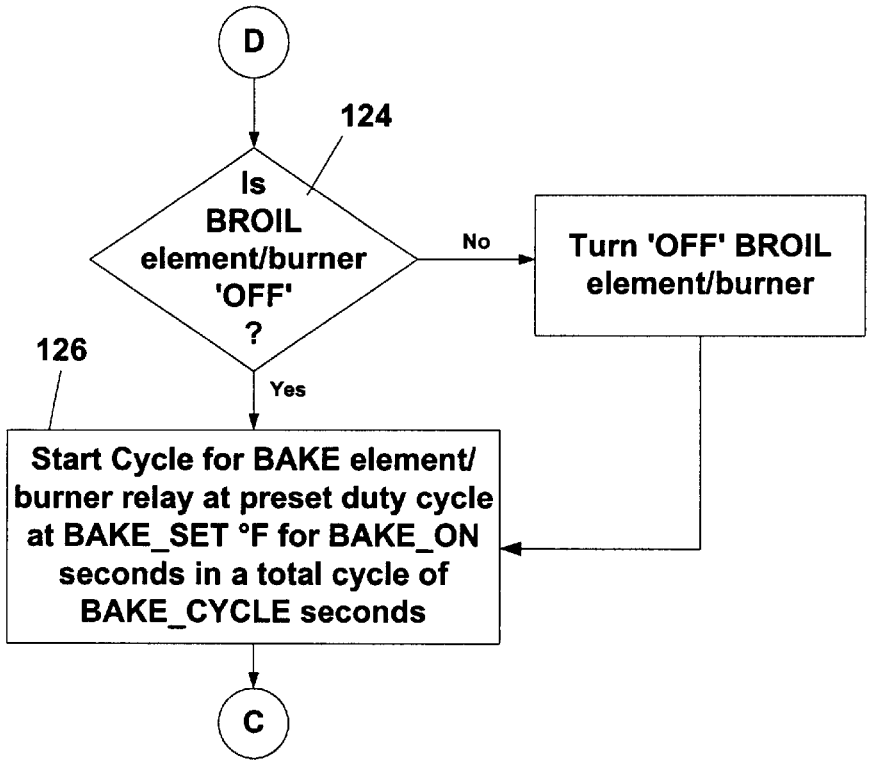
FIG. 8 is a flowchart showing the method steps performed if subprocess "D" is called from FIG. 6.

At decision point 112, it is determined whether the value of the signal BAKE_TEMP emitted by the bake temperature sensor 32 is less than the desired lower temperature limit for the bake heating element 18 BAKE_LTL. If so, the subprocess shown in FIG. 8 is called via the connector "D" shown in FIG. 6. If not, processing moves to step 114.

At step 114, the controller 34 receives a signal from the broil temperature sensor 30 corresponding to the temperature BROIL_TEMP read by the broil temperature sensor 30. It should also be noted that processing returns from the subprocess noted by "B" and the subprocess identified by "D" to the method step shown in FIG. 6 by the connector shown as "C" which returns the processing of these subprocesss to step 114 as well.

Figure 9:
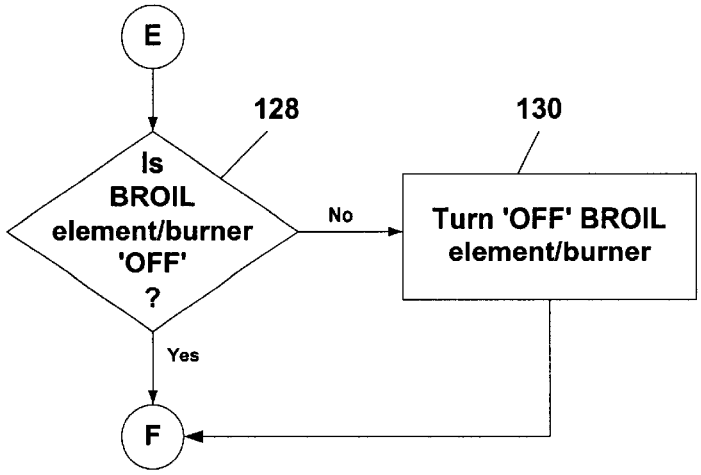
FIG. 9 is a flowchart showing the method steps performed if subprocess "E" is called from FIG. 6.

Processing then moves to decision point 116. At decision point 116, the controller 34 determines whether the value BROIL_TEMP read in step 114 exceeds the desired high temperature limit for the broil heating element 16 BROIL_HTL. If so, the subprocess shown in FIG. 9 is called as indicated by connector "E" in FIG. 6. If not, processing passes to decision point 118.

Figure 10:
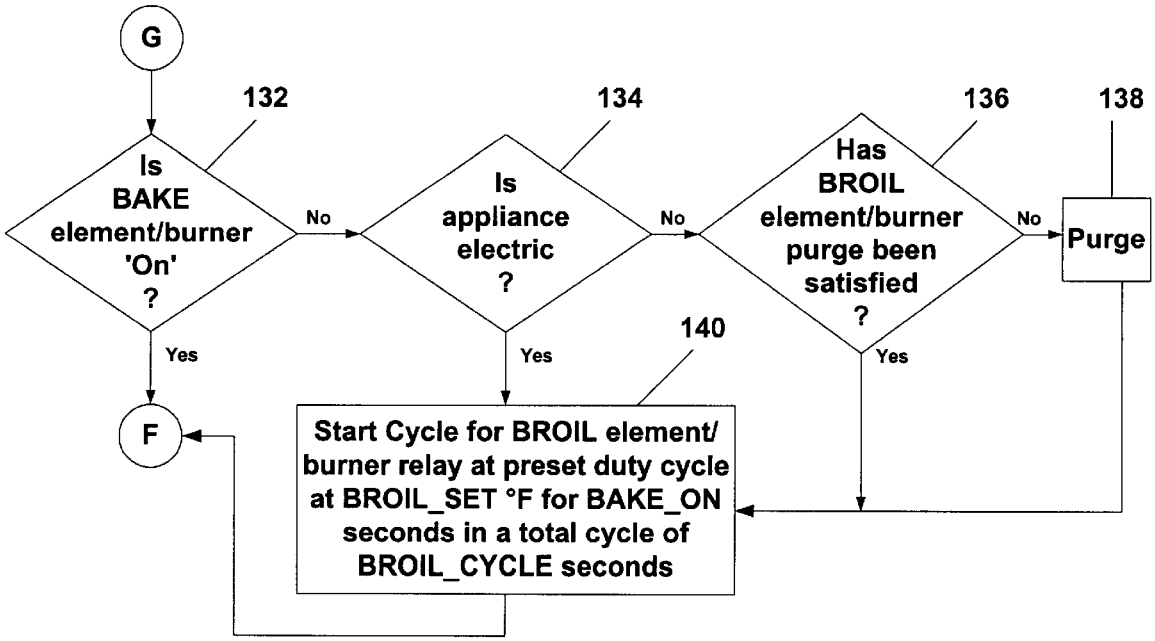
FIG. 10 is a flowchart showing the method steps performed if subprocess "G" is called from FIG. 6.

At decision point 118, the controller 34 determines whether the value read by the broil temperature sensor 30 BROIL_TEMP is less than the desired lower temperature limit for the broil heating element 16 BROIL_LTL. If so, the subprocess of FIG. 10 is called as indicated by connector "G" on FIG. 6. If not, processing passes to the intermediate point indicated by connector "F" in FIG. 6. At which time processing loops back to step 108.

It should also be noted that the subprocess of FIG. 9 as indicated by connector "E" on FIG. 6 and the subprocess of FIG. 10 indicated by connector "G", each return their processing to the connector indicated as "F" on FIG. 6 and, thereby, also loop back to step 108 for continued processing of the main loop shown in FIG. 6.

FIG. 7 represents the subprocess called by decision point 110 if the temperature signal BAKE_TEMP read in step 108 exceeds the desired high temperature limit for the bake heating element 18 BAKE_HTL. Processing then moves to decision point 120 at which point the controller 34 determines whether the bake heating element 18 is OFF. If the bake heating element is OFF, the subprocess merely loops back via the connector shown as "C" whereby processing is returned to step 114 of FIG. 6.

If the bake heating element 18 is ON, processing moves to step 122 where the controller deactivates the bake heating element 18. Processing then returns to step 114 of FIG. 6 via the connector shown at "C". The net effect of this subprocess is to turn off the bake heating element 18 if the bake temperature sensor 32 reads a temperature BAKE_TEMP in excess of the high temperature limit BAKE_HTL as determined in the database 104.

FIG. 8 represents the method steps performed when decision point 112 determines that the temperature signal emitted by the bake temperature sensor 32 BAKE_TEMP is less than the desired lower temperature limit for the bake heating element 18 BAKE_LTL. Processing then moves to decision point 124 where the controller 34 determines whether the broil heating element 16 is currently deactivated, i.e., in all OFF state. If so, processing moves to step 126 where the bake heating element is activated for its predefined duty cycle as determined by the controller 34 in the database 104.

Specifically, the duty cycle activates the bake heating element 18 for a cycle of BAKE_CYCLE seconds of which the bake heating element 18 is on for BAKE_ON seconds of that total cycle time at a temperature of BAKE_SET degrees F. It should be noted that the duty cycle of the bake heating element 18 is started at step 126 and is continuing as processing is returned via the connector "C" to step 114 in FIG. 6.

The net effect of the subprocess steps of FIG. 8 is, once a determination is made that the bake temperature sensor 32 is reading a temperature BAKE_TEMP less than the desired lower temperature limit for the bake heating element 18 BAKE_LTL, the duty cycle for the bake heating element 18 is initiated but only after deactivating the broil heating element 16 to ensure that the broil and bake heating element 16 and 18 are not actuated at the same time which can cause sudden uncontrolled temperature increases in the baking cavity 12.

FIG. 9 represents the subprocess called by decision point 116 if the temperature signal BROIL_TEMP read in step 116 exceeds the desired high temperature limit for the broil heating element 16 BROIL_HTL. Processing then moves to decision point 128 at which point the controller 34 determines whether the broil heating element 16 is OFF. If the broil heating element 16 is OFF, the subprocess merely loops back via the connector shown as "F" whereby processing is returned via connector "F" to FIG. 6. If the broil heating element 16 is ON, processing moves to step 130 where the controller 34 deactivates the broil heating element 16. Processing then returns to FIG. 6 via the connector shown at "F". The net effect of this subprocess is to turn off the broil heating element 16 if the broil temperature sensor 30 reads a temperature BROIL_TEMP in excess of the high temperature limit BROIL_HTL as determined in the database 104.

FIG. 10 represents the subprocess called a decision point 118 when the controller 34 determines that the temperature signal BROIL_TEMP sent by the broil temperature sensor 30 is less than the desired lower temperature limit for the broil heating element 16 BROIL_LTL. If so, processing moves along connector "G" from FIG. 6 to FIG. 10 to decision point 132.

At decision point 132, the controller 34 determines whether the bake heating element 18 is currently activated, i.e., in an ON state. If so, processing returns to FIG. 6 via connector "F" which thereby returns processing to step 108 in FIG. 6. If the bake heating element 18 is not currently ON, processing moves to decision point 134 where the controller checks whether this is an electric-based oven 10 or a gas-based oven 10. If a gas-based oven 10 is detected (i.e., the test whether the oven is electric fails), processing moves to decision point 136. At decision point 136, the controller 34 determines whether the broil heating element 16 burner purge time has been satisfied (gas-based systems require a certain amount of time to elapse before a heating element may be reactivated).

If the burner purge time has not been satisfied, processing moves to step 138 at which time the gas-based broil heating element 16 is purged in a manner that is well known in the art. After which, processing moves to step 140.

It should also be noted that should the test at decision points 134 and 136 be satisfied in the affirmative, i.e., there is an electric-based oven 10 at issue or the broil heating element 16 purge time has been satisfied, processing also moves directly to step 140. Also, the cycle can be optimized for either an electric or gas oven, instead of the illustrated process that checks for the type of oven. If optimized for one type of oven, the process steps specific to the non-optimized oven can be dropped.

At step 140, the duty cycle for the broil heating element 16 is initiated in the same manner as described with respect to the bake heating element 18 duty cycle described in step 126 of FIG. 8. Specifically, a duty cycle of a total cycle time of BROIL_CYCLE seconds of which the broil heating element 16 is activated and emitting heat for BROIL_ON seconds of that total cycle time.

After the duty cycle for the broil heating element 16 is initiated at step 140, processing returns along the connector "F" to its corresponding connection point "F" at FIG. 6 which thereafter returns processing to step 108 to repeat the steps of FIG. 6.

The net effect of the steps shown in FIG. 10, once it is established that the temperature BROIL_TEMP detected by the broil temperature sensor 30 is less than the desired lower temperature limit BROIL_LTL of the broil heating element 16, is to leave the bake heating element 18 on if it is currently on when the subprocess of FIG. 10 is called. Otherwise, if the bake heating element 18 is off, the duty cycle for the broil heating element 16 is immediately initiated at step 140 for an electric-based oven as determined at decision step 134. For a gas-based oven 10, the controller 34 ensures that the broil heating element 16 purge time has been satisfied and only then initiates the duty cycle for the broil heating element at step 140.

As stated above, once the duty cycle is initiated at step 140, processing returns via connector "F" to FIG. 6 where the cycle of FIG. 6 repeats until the bake time is reached or canceled by the user. The broil and bake heating elements 16 and 18 are activated by the controller 34 as needed with priority given to the bake heating element 18.

It is believed that the basic invention disclosed herein is the concept of employing a pair of temperature sensors, i.e., the bake temperature sensor 32 located adjacent the bake heating element 18 and the broil temperature sensor 30 located adjacent the broil heating element 16 to independently control the corresponding heating elements. Because the broil and bake temperature sensors 30, 32 are located relatively close to their respective broil and bake heating elements 16, 18, respectively, the temperature sensors 30, 32 are available to allow the broil and bake heating elements 16, 18 to be independently controlled based upon a signal from the corresponding temperature sensor 30, 32. The signal from the sensors is also more indicative of the local temperature of the oven cavity corresponding to the location of the respective heating element. Thus, greater temperature control and accuracy can be achieved within the baking cavity 12 of the oven 10.

The relative spacing of the sensor and corresponding element can vary from what is disclosed in the drawings without departing from the invention. If the spacing is great enough some of the high and low element set points might need to be altered to maintain the desired even temperature distribution throughout the oven cavity. What is important to the invention is that the broil element is used to control the local temperature of the portion of the oven above a pan in the oven cavity, the bake element controls the local temperature below the pan, and the elements collectively control the overall temperature of the entire oven cavity through the independent localized temperature control.

It has been found that this invention has equal applicability and value for implementation on both electric-based and gas-based ovens as described previously with respect to FIGS. 3 and 4, respectively. It will be understood that the broil heating element 16 and bake heating element 18 can be any of well-known heating elements such as wire-or coil-based heating elements as are typically used in electric-based ovens or gas-based burners typically employed in gas-based ovens.

The example database 104 shown in Table 1 illustrates that different temperature set points, i.e., BROIL_SET and BAKE_SET are established for the corresponding broil temperature sensor 30 and the bake temperature sensor 32 which can be a function of the location of the particular temperature sensor 30, 32 to its corresponding heating element 16, 18, respectively. It should also be noted, as previously described, that the preheat temperatures BROIL_PRE and BRAKE_PRE are preferably greater than the corresponding desired target temperature TARGET_TEMP set by the user 67 on the control panel 76 at the initiation of the BAKE mode heating cycle of the oven 10. Additionally, the duty cycles of the broil heating element 16 and the bake heating element 18 can be initiated at different duty cycles as defined by the BROIL_CYCLE, BROIL_ON, BAKE-CYCLE, and BAKE_ON as corresponding to the particular target temperature set point TARGET_TEMP for the broil heating element 16 and bake heating element 18 as determined by the target set points for each heating element, i.e., BROIL_SET and BAKE_SET, respectively.

In the example shown in Table 1, the broil heating element 16 is cycled according to a certain pre-set duty cycle for the defined low, mid and high temperature bands of operation and the bake heating element 18 is operated at a different duty cycle for each of these temperature bands. In the example shown in Table 1, the bake heating element 18 is operated at a 100% duty cycle for each of the temperature bands, i.e., BAKE_CYCLE=BAKE_ON thus defining that the bake heating element is activated for the entire length of the total cycle time of the duty cycle for the bake heating element 18.

A compensation method is also contemplated by the inventive method described herein since, during preheating of the baking cavity 12 of the oven 10, the temperature of the baking cavity typically overshoots the desired temperature TARGET_TEMP set by the user 67 on the control panel 76. Accordingly, after the preheating cycle completes, there is typically an idle period wherein the actual ambient temperature within the baking cavity 12 of the oven 10 falls from its overshoot position above the desired temperature TARGET_TEMP set by the user 67 toward the desired temperature TARGET_TEMP set by the user.

The compensation routine contemplated by this invention includes a compensation subprocess which can be called by any of the steps of FIGS. 6–10 to modify any of the target set points of the method steps and decision points herein (e.g., BROIL_SET, BROIL_HTL, BROIL_LTL, BAKE_SET, BAKE_HTL and BAKE_LTL). The modification of these values, generally upwardly, prevents the actual temperature of the baking cavity 12 of the oven 10 from falling too quickly since the cooling rate of the baking cavity 12 corresponds to the difference between the actual oven temperature (such as the overshot oven temperature after the preheating cycle) and the desired target temperature for which the broil heating element 16 and the bake heating element 18 will be idle during this overshot period.

Figure 11:
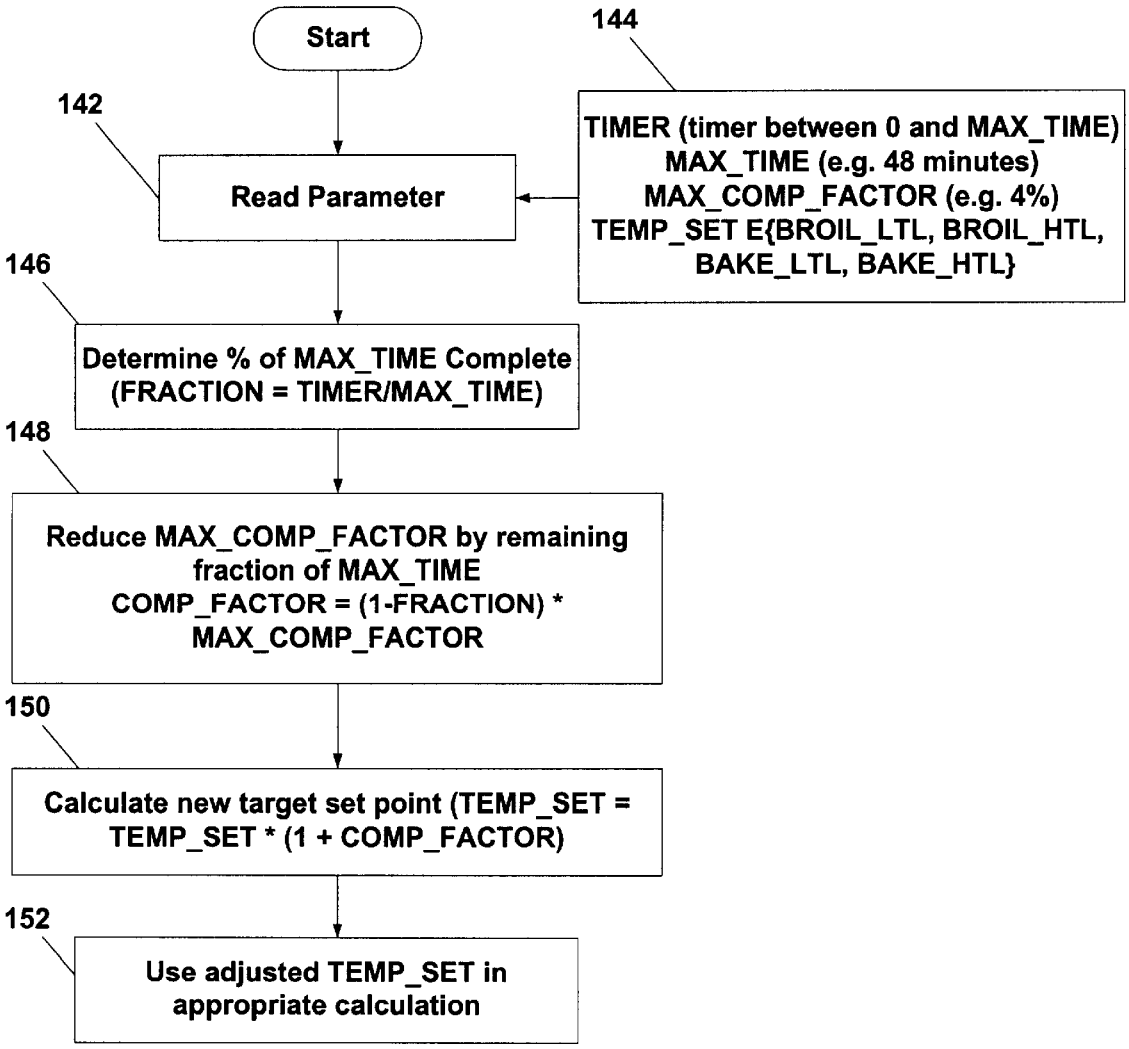
FIG. 11 is a flowchart showing a compensation routine for various temperature set points employed in the method steps of FIGS. 6–10 for compensation of temperature set points relating to the bake and broil heating elements due to a typical overshooting of the desired oven cavity temperature during preheating of the oven whereby the compensation steps of FIG. 11 artificially increase the target set points of both the broil and bake heating elements to prevent extended idle control times during the controlled heating of the oven cavity during a bake mode.

The compensation method is detailed in FIG. 11 and can essentially be called as a subprocess from any of the decision points and method steps to modify the values discussed above. Processing begins in the compensation method at step 142 wherein the compensation method receives various parameters as outlined in data box 144.

The data box 144 contains the parameters necessary for the compensation method of FIG. 11 including: TIMER representative of a clock count between zero seconds or minutes and MAX_TIME representative of the total length of time of the compensation method of FIG. 11. The data box 144 also contemplates a parameter titled MAX_COMP_FACTOR corresponding to the maximum amount that a particular temperature point will be compensated. Finally, the compensation method of FIG. 11 is provided with a value TEMP_SET representative of, or as an element of, one of the temperature values indicated above, i.e., $$\text{TEMP_SET} \in \left\{ \begin{array}{c} \text{BROIL_SET, BROIL_HTL, BROIL_LTL,} \\ \text{BAKE_SET, BAKE_HTL and BAKE_LTL} \end{array} \right\}.$$

Once the compensation method of FIG. 11 has the required parameters at step 142 processing moves to step 146 at which the controller 34 determines the fraction of the total compensation cycle time (MAX_TIME) elapsed during this cycle of the compensation method by calculating:

FRACTION=TIMER/MAX_TIME

Processing then moves to step 148 where the maximum compensation factor MAX_COMP_FACTOR is adjusted according to the fraction of the compensation cycle time remaining, i.e., (1−FRACTION) as calculated in step 146. Thus, an example of a linear MAX_COMP_FACTOR reduction formula which linearly reduces the amount of adjustment to MAX_COMP_FACTOR along the length of the compensation cycle would be indicated by:

COMP_FACTOR=(1−FRACTION)·MAX_COMP_FACTOR

Processing then moves to step 150 where the temperature value target set point TEMP_SET passed to the compensation method of FIG. 11 is calculated based upon the compensation factor COMP_FACTOR calculated in step 148 according to whatever linear or non-linear function is desired or employed at step 148 (a linear function is shown, but any non-linear or other function can be employed at step 148 without departing from the scope of this invention). The new target set point TEMP_SET is calculated as:

TEMP_SET=TEMP_SET·(1+COMP_FACTOR).

Processing then moves to step 152 where the compensation method of FIG. 11 returns the adjusted TEMP_SET value calculated at step 150 in whatever decision point or step that called the compensation method of FIG. 11.

For example, if the compensation method of FIG. 11 employed a 48-minute timer, i.e., MAX_TIME=48 minutes or 2,880 seconds and TIMER represents an integral value between 0 and MAX_TIME, the controller 34 would also store a value for MAX_COMP_FACTOR such as 0.04 for a 4% upward adjustment in the set point TEMP_SET passed to the compensation method of FIG. 11. In the linear compensation routine proposed at step 148 by the example in FIG. 11, the value FRACTION would, calculated as a value between 0.00 and 1.00 based upon the ratio of TIMER to MAX_TIME would cause the value COMP_FACTOR to be a reducing linear value between MAX_COMP_FACTOR at TIMER=0 and 0.00 at TIMER=MAX_TIME. The value temp set would then be multiplied by this calculated value to upwardly adjust the value TEMP_SET to the compensated amount.

It has been found that the overshooting of the desired target temperature TARGET_TEMP of the baking cavity 12 as well as the location of the broil temperature sensor 30 and the bake temperature 32 closely adjacent to the broil heating element 16 and the bake heating element 18 creates this need for the compensation algorithm of FIG. 11 to control the temperature in the baking cavity 12 even more closely than that contemplated by the steps of FIGS. 6–10. This compensation method of FIG. 11 prevents the temperature variance or rate of change of the temperature in the baking cavity 12 from changing radically and far reduces the temperature variance between the high temperature experienced and the low temperature experienced at a particular desired target temperature TARGET_TEMP.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for accurately controlling the ambient temperature in an enclosed baking cavity of an oven that is preheated with respect to a user-selected temperature set point, the baking cavity of the oven having a broil heating element mounted to an upper portion of the baking cavity and a bake heating element mounted to a lower portion of the baking cavity defining a baking region therebetween, a broil temperature sensor is mounted within the baking cavity adjacent to the broil heating element, a bake temperature sensor is mounted within the baking cavity adjacent to the bake heating element, the method comprising:

providing a controller operably interconnected to a power source and to the broil heating element, bake heating element, the broil temperature sensor and the bake temperature sensor for selectively actuating the broil heating element and the bake heating element in response to the sensed temperature of one or both the broil temperature sensor and the bake temperature sensor;

determining a target temperature set point for the oven cavity based on the user-selected temperature set point by calculating a heating element set point comprising both a broil set point and a bake set point derived from the target temperature set point;

sensing the temperature of the baking region adjacent at least one of the bake and broil heating elements;

comparing the sensed temperature with the target temperature set point; and selectively actuating the broil heating element and the bake heating element in response to the sensed temperature of the baking region to maintain a vertical temperature distribution in the oven cavity that is substantially equal to the target temperature set point.

2. The method of claim 1, wherein the step of calculating the one of the bake and broil element set points comprises selecting the one of the bake and broil set points from a data table containing a list of target temperature set points and a corresponding list of at least the one of the bake and broil set points.

3. The method of claim 2, wherein the broil set point and the bake set point each comprise a range of temperature values delimited by a low temperature limit and a high temperature limit.

4. The method of claim 3, wherein the step of calculating the broil and bake set points further comprises selecting a temperature differential value corresponding to the target temperature set point and summing the temperature differential value with the selected at least one of the bake and broil set points to calculate the other of the at least one of the bake and broil set points.

5. The method of claim 4, wherein the temperature differential value can be either negative or positive.

6. The method of claim 5, wherein the step of sensing the temperature comprises reading a sensor temperature signal comprising one of a bake temperature signal and a broil temperature signal read from the corresponding bake temperature sensor and broil temperature sensor.

7. The method of claim 1, wherein the step of selectively actuating the broil and bake heating elements comprises alternately activating the bake and broil heating elements.

8. The method of claim 7, wherein the step of alternately activating the broil and bake heating elements comprises at least one of the following steps:

deactivating the heating element corresponding to the sensed temperature if the sensed temperature exceeds the corresponding heating element set point;

activating the heating element corresponding to the sensed temperature if the sensed temperature is less than the corresponding heating element set point; and deactivating the heating element other than the heating element corresponding to the sensed temperature if the sensed temperature is less than the heating element set point.

9. The method of claim 1, wherein the step of selectively activating the bake and broil heating elements comprises the step of deactivating one of the bake and broil heating elements if the one of the bake and broil heating elements is activated and if the sensed temperature is less than the corresponding bake or broil set point by a predetermined amount.

10. The method of claim 9, and further comprising the step of activating the other of the bake and broil heating elements for a predetermined duty cycle as long as the one of the bake and broil heating elements is deactivated.

11. The method of claim 1, and further comprising the step of detecting whether the oven is gas-based or electric-based.

12. The method of claim 11, and further comprising the step of determining whether a purge time limit for the broil heating element has been satisfied when the oven is gas-based/powered.

13. The method of claim 12, and further comprising the step of purging the broil heating element if the purge time limit has not been satisfied and if a gas-based oven has been detected.

14. The method of claim 1 and further comprising the step of compensating the heating element set point based upon an initial heating condition of the baking cavity.

15. The method of claim 14 wherein the heating element set point is increased in the compensation step.

16. The method of claim 15 wherein the compensating step further comprises adjusting the heating element set point according to a predefined function.

17. The method of claim 16 wherein the function is a decreasing linear function.

18. An oven incorporating accurate ambient temperature control comprising:

a housing defining an enclosed baking cavity;

at least one oven rack for supporting a pan is positioned within the baking cavity and conceptually dividing the cavity into an upper heating region above the rack and a lower heating region below the rack;

a broil heating element mounted in the upper heating region of the baking cavity;

a bake heating element mounted in the lower heating region of the baking cavity;

a broil temperature sensor mounted within the upper heating region adjacent to the broil heating element;

a bake temperature sensor mounted within the lower heating region adjacent to the bake heating element;

a controller configured to calculate a heating element set point comprising both a broil set point and a bake set point derived from the target temperature set point and operably interconnected to a power source and to the broil heating element, bake heating element, the broil temperature sensor and the bake temperature sensor for selectively actuating the broil heating element and the bake heating element in response to the sensed temperatures of the upper and lower heating regions to maintain the temperature of the upper and lower heating regions substantially equal to the target temperature set point.

19. The oven of claim 18, wherein a sensor temperature signal comprising one of a bake temperature signal and a broil temperature signal is read from a corresponding heating element sensor comprising one of the bake temperature sensor and broil temperature sensor.

20. The oven of claim 19, wherein the controller compares the sensor temperature signal to the heating element set point.

21. The oven of claim 20, wherein the controller deactivates the corresponding heating element if the sensor temperature signal exceeds the heating element set point.

22. The oven of claim 21, wherein the controller activates the corresponding heating element if the sensor temperature signal is less than the heating element set point.

23. The oven of claim 22, wherein the controller deactivates the heating element other than the corresponding heating element if the sensor temperature signal is less than the heating element set point.

24. The oven of the claim 19, controller deactivates one of the bake and broil heating elements if the one of the bake and broil heating elements is activated and if the corresponding bake or broil temperature signal exceeds the corresponding bake or broil set point by a predetermined amount.

25. The oven of claim 24, wherein the controller activates the one of the bake and broil heating element for a predetermined duty cycle as long as the other of the bake and broil heating elements is deactivated.

26. The oven of claim 18, wherein the controller includes a database comprising multiple target temperature set points and corresponding broil set points and bake set points whereby the bake and broil set points can be selected from the table according to the target temperature set point.

27. The oven of claim 26, wherein the broil set point and the bake set point each comprise a range of temperature values delimited by a low temperature limit and a high temperature limit.

28. The oven of claim 18, wherein the controller compensates the heating element set point based upon an initial heating condition of the baking cavity.

29. The oven of claim 28, wherein the compensation increases the heating element set point.

30. The oven of claim 29, wherein the compensation adjusts the heating element set point according to a predefined function.

31. The oven of claim 30, wherein the function is a decreasing linear function.

32. A method for maintaining an even temperature distribution in a baking cavity of an oven relative to a user-selected temperature set point, the baking cavity of the oven having rack for supporting a pan, with the rack functionally dividing the cavity into an upper heating region above the rack and a lower heating region below the rack, a broil heating element and a corresponding broil temperature sensor are provided in upper heating region, and a bake heating element and a bake temperature sensor are provided in the lower heating region, the method comprising the steps of:

providing a controller operably connecting a power source to the broil heating element, the bake heating element, the broil temperature sensor and the bake temperature sensor for selectively actuating the broil heating element and the bake heating element in response to the temperature of the upper and lower heating regions;

determining a target temperature set point for the oven cavity based on the user-selected temperature set point by calculating a heating element set point comprising both a broil set point and a bake set point from the target temperature set point;

sensing the temperature of the upper and lower heating regions;

comparing the sensed temperature of the upper and lower heating regions with the target temperature set point; and selectively actuating the broil heating element and the bake heating element in response to the sensed temperature of the upper and lower heating regions to maintain the upper and lower heating regions substantially equal to the target temperature set point.

33. The method of claim 32, wherein the step of calculating the one of the bake and broil element set points comprises selecting the one of the bake and broil set points from a data table containing a list of target temperature set points and a corresponding list of at least the one of the bake and broil set points.

34. The method of claim 33, wherein the broil set point and the bake set point each comprise a range of temperature values delimited by a low temperature limit and a high temperature limit.

35. The method of claim 34, wherein the step of calculating the broil and bake set points further comprises selecting a temperature differential value corresponding to the target temperature set point and summing the temperature differential value with the selected at least one of the bake and broil set points to calculate the other of the at least one of the bake and broil set points.

36. The method of claim 35, wherein the temperature differential value can be either negative or positive.

37. The method of claim 32, wherein the step of sensing the temperature comprises reading a sensor temperature signal comprising one of a bake temperature signal and a broil temperature signal read from the corresponding bake temperature sensor and broil temperature sensor.

38. The method of claim 32, the step of selectively activating the broil and bake heating elements comprises alternately activating the bake and broil heating elements.

39. The method of claim 38, wherein the step of alternately activating the broil and bake heating elements comprises at least one of the following steps:

deactivating the heating element corresponding to the sensed temperature if the sensed temperature exceeds the corresponding heating element set point;

activating the heating element corresponding to the sensed temperature if the sensed temperature is less than the corresponding heating element set point; and deactivating the heating element other than the heating element corresponding to the sensed temperature if the sensed temperature is less than the heating element set point.

40. The method of claim 38, wherein the step of alternately activating the bake and broil heating elements comprises activating one of the bake and broil heating elements for a predetermined duty cycle as long as the other of the bake and broil heating elements is deactivated.

41. The method of claim 32, further comprising the step of compensating the heating element set point based upon an initial heating condition of the baking cavity.

42. The method of claim 41, the heating element set point is increased in the compensation step.

43. The method of claim 42, wherein the compensating step further comprises adjusting the heating element set point according to a predefined function.

44. The method of claim 43, wherein the function is a decreasing linear function.

* * * * *